US011549220B2

(12) United States Patent
Matzinger et al.

(10) Patent No.: US 11,549,220 B2
(45) Date of Patent: Jan. 10, 2023

(54) TAMPING UNIT FOR TAMPING SLEEPERS OF A TRACK

(71) Applicant: PLASSER & THEURER EXPORT VON BAHNBAUMASCHINEN GESELLSCHAFT MBH, Vienna (AT)

(72) Inventors: Nikolaus Matzinger, Oberneukirchen (AT); Lothar Stadler, Vienna (AT)

(73) Assignee: Piasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 554 days.

(21) Appl. No.: 16/498,019

(22) PCT Filed: Apr. 5, 2018

(86) PCT No.: PCT/EP2018/058675
§ 371 (c)(1),
(2) Date: Sep. 26, 2019

(87) PCT Pub. No.: WO2018/202380
PCT Pub. Date: Nov. 8, 2018

(65) Prior Publication Data

US 2021/0102344 A1 Apr. 8, 2021

(30) Foreign Application Priority Data

May 3, 2017 (AT) ..... A 179/2017

(51) Int. Cl.
*E01B 27/16* (2006.01)
*B06B 1/16* (2006.01)

(52) U.S. Cl.
CPC ..... *E01B 27/16* (2013.01); *B06B 1/16* (2013.01); *E01B 2203/127* (2013.01)

(58) Field of Classification Search
CPC ..... E01B 27/16; E01B 2203/127; B06B 1/16
See application file for complete search history.

(56) References Cited

U.S. PATENT DOCUMENTS 2,791,971 A * 5/1957 Schnellmann ..... E01B 27/16 104/12
3,901,159 A * 8/1975 Von Beckmann ..... E01B 27/16 104/12

(Continued)

FOREIGN PATENT DOCUMENTS

CN 86107743 A 5/1988
CN 201433341 Y 3/2010

(Continued)

*Primary Examiner* — Robert J McCarry, Jr.
(74) *Attorney, Agent, or Firm* — Laurence A. Greenberg; Werner H. Stemer; Ralph E. Locher

(57) ABSTRACT

A tamping unit for tamping sleepers of a track includes a lowerable tool carrier and oppositely positioned tamping tools. Each tamping tool is connected via a pivot arm to a squeezing drive for producing a squeezing motion and to an electric vibration drive for producing a vibratory motion. The electric vibration drive includes an eccentric shaft which, together with a rotor of an electric motor, is mounted merely in an eccenter housing. A stator of the electric motor with a motor housing is flange-mounted to the eccenter housing. As a result of the omission of a separate motor mounting, the motor housing has a particularly small overall depth.

9 Claims, 3 Drawing Sheets

(56) References Cited

U.S. PATENT DOCUMENTS

| | | | | |
|---|---|---|---|---|
| 3,998,165 | A * | 12/1976 | Jaeggi | E01B 27/16 104/12 |
| 9,803,323 | B2 * | 10/2017 | Hofstaetter | E01B 27/16 |
| 9,812,924 | B2 * | 11/2017 | Terauchi | H02K 7/108 |
| 9,957,668 | B2 * | 5/2018 | Lichtberger | E01B 27/16 |
| 2016/0153150 | A1 * | 6/2016 | Salciccia | B06B 1/18 104/12 |
| 2017/0019012 | A1 * | 1/2017 | Sami | H02K 11/30 |
| 2018/0309353 | A1 * | 10/2018 | Sami | H02K 11/30 |
| 2021/0102344 | A1 * | 4/2021 | Matzinger | E01B 27/16 |
| 2021/0355638 | A1 * | 11/2021 | Boeck | E01B 27/17 |
| 2021/0395953 | A1 * | 12/2021 | Philipp | E01B 27/16 |
| 2022/0034043 | A1 * | 2/2022 | Philipp | E01B 27/16 |
| 2022/0034046 | A1 * | 2/2022 | Meier | E02D 3/0265 |

FOREIGN PATENT DOCUMENTS

| | | | |
|---|---|---|---|
| CN | 101725093 | A | 6/2010 |
| CN | 202671987 | U | 1/2013 |
| CN | 105074089 | A | 11/2015 |
| CN | 105189868 | A | 12/2015 |
| CN | 105610273 | A | 5/2016 |
| DE | 2417062 | A1 | 2/1976 |
| JP | S5393505 | A | 8/1978 |
| WO | 2016101320 | A1 | 6/2016 |

* cited by examiner

TAMPING UNIT FOR TAMPING SLEEPERS OF A TRACK

BACKGROUND OF THE INVENTION

Field of the Invention

The invention relates to a tamping unit for tamping sleepers of a track, having a lowerable tool carrier and oppositely positioned tamping tools, wherein each tamping tool is connected via a pivot arm to a squeezing drive for producing a squeezing motion and to an electric vibration drive for producing a vibratory motion.

Description of the Related Art

Tamping units for tamping sleepers of a track are already well known. In this, a vibratory motion is produced by means of an eccentric drive. The latter comprises a rotatable eccentric shaft to which squeezing drives are articulatedly connected for transmitting the vibrations to the tamping tines.

According to DE 24 17 062 A1, a tamping unit is known in which, for producing vibrations, eccentric mounting bushings are arranged in the pivot arms of the tamping tines. Via a chain drive, a rotary motion is transmitted to the eccentric mounting bushings by a drive shaft powered by an electric motor.

SUMMARY OF THE INVENTION

It is the object of the invention to provide an improvement over the prior art for a tamping unit of the type mentioned at the beginning.

According to the invention, this object is achieved by way of a tamping unit for tamping sleepers of a track, having a lowerable tool carrier and oppositely positioned tamping tools, wherein each tamping tool is connected via a pivot arm to a squeezing drive for producing a squeezing motion and to an electric vibration drive for producing a vibratory motion. Dependent claims indicate advantageous embodiments of the invention.

The invention provides that the electric vibration drive comprises an eccentric shaft which, together with a rotor of an electric motor, is mounted merely in an eccenter housing, and that a stator of the electric motor with a motor housing is flange-mounted to the eccenter housing. The clear advantage here lies in the compactness and the small design of the tamping unit. As a result of the omission of a separate motor mounting, the motor housing has a particularly small overall depth. Also, in the arrangement according to the invention, no gearbox is provided, resulting in a high degree of efficiency and great stability of the drive.

In addition, the rotor of the electric motor functions as an oscillating weight, as a result of which a separate flywheel can be omitted. By means of the oscillating weight, kinetic energy is intermediately stored during a vibration oscillation cycle, resulting in a high overall degree of effectiveness of the vibration production. As a further advantage, the use of the electric motor directly at the eccentric shaft allows a particularly quick change of the vibration frequency. In this way, the frequency can be continually adapted during a tamping cycle. For example, the frequency is increased during penetration into a ballast bed and reduced or shut off when the tamping unit is in raised position.

In this, it is useful if the electric motor is a torque motor designed as an internal rotor. Torque motors have very high torques at relatively low rotational speeds. The great drive moment of torque motors enables high accelerations. The resulting great dynamic of the system has a positive effect on the tamping unit immersed with its tamping tines into a ballast bed. There is hardly any wear in the torque motor, which has a positive effect on the maintenance of the tamping unit.

A further advantageous detail of the invention is a water cooling associated with the electric motor. Thus, the heat developing from the electric motor in operation is dissipated as fast as possible. The electric motor including the water cooling is designed encapsulated, so that none of the dust arising during tamping can get inside the motor.

In an advantageous embodiment of the invention, it is provided that a form-locking connection to the rotor is provided at an end, facing the motor housing, of the eccentric shaft. This ensures a reliable force transmission.

A continuing variant provides that the form-locking connection is designed as external teeth of the eccentric shaft and internal teeth of a sleeve connected to the rotor. As a result of the interlocking of two connecting partners (eccentric shaft, rotor), a durable stable force transmission is ensured. A consistent transmission of the torque takes places via the tooth flanks of the multiple drive-type fastening. During maintenance and repair work, the internal teeth of the rotor are simply pulled off the external teeth of the eccentric shaft. A simple installation takes place in reverse order.

In another continuing variant, the form-locking connection is designed as a screw connection. On the one hand, this provides a secure transmission of the torque, and on the other hand, maintenance tasks can already be performed with simple tools on site.

Advantageously, the motor housing is sealed by means of a sealing ring with respect to the eccenter housing at a feed-through of the eccentric shaft. With this, lube oil possibly present in the eccenter housing is permanently prevented from entering the motor housing.

It is additionally advantageous if the motor housing is positioned relative to the eccenter housing by means of a centering. Thus, the motor housing does not need to be aligned relative to the eccenter housing first in order to form an even air gap between rotor and stator.

In a further advantageous embodiment, the eccentric shaft has several eccentric sections, wherein different eccentric sections are associated with the oppositely positioned tamping tools. Thus, a favourable mirror-inverted vibration oscillation is achieved at the oppositely positioned tamping tools.

Another advantageous embodiment provides that the eccentric shaft has an eccentric section on which a transmission element for transmitting the vibratory motion is mounted. Then, both squeezing drives are arranged on the transmission element for transmitting the vibration oscillation. An arrangement of this type enables in a simple manner a change of a transmitted vibration amplitude. With a transmission element designed as a connecting rod, the eccenter housing can be sealed in a simple way, whereby a submersed oil lubrication can be realized in a simple manner. In addition, the moved masses at the tamping unit are reduced, thus achieving a reduction of noise.

BRIEF DESCRIPTION OF THE SEVERAL VIEWS OF THE DRAWING

The invention will be described by way of example below with reference to the attached figures. There is shown in schematic representation in.

DESCRIPTION OF THE INVENTION

Figure 1:
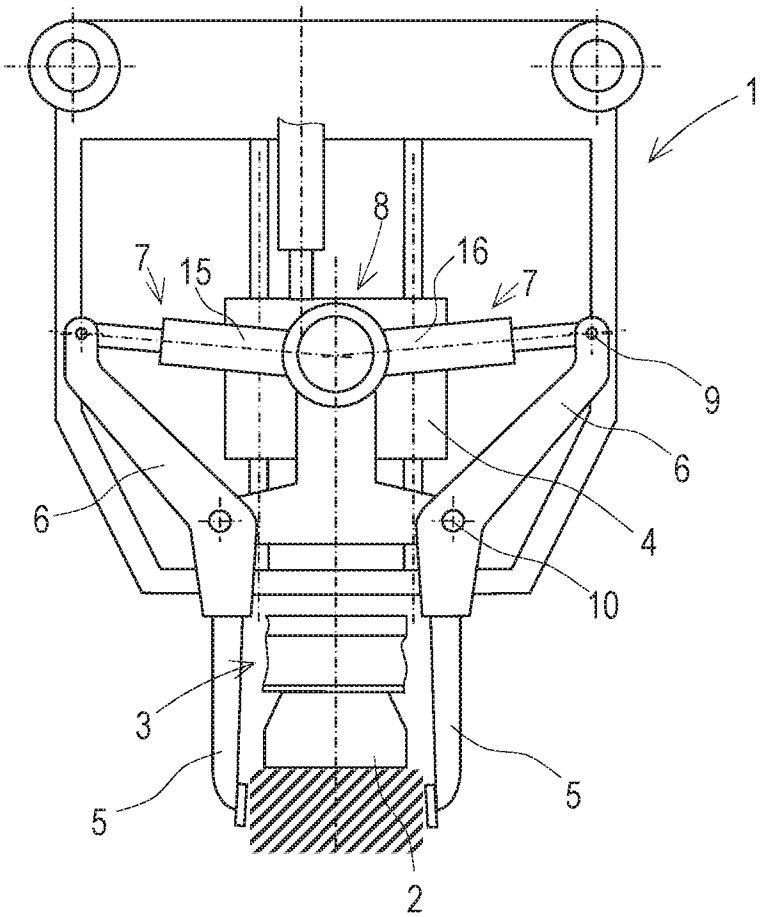
FIG. 1 front view of tamping unit
FIG. 2 side view of tamping unit
FIG. 3 detail view of eccenter housing and motor housing
FIG. 4 detail view of motor housing

FIG. 1 shows a tamping unit 1, depicted in a simplified way, for tamping sleepers 2 of a track 3, having a lowerable tool carrier 4 and pairs of two oppositely positioned tamping tools 5. Each tamping tool 5 is connected via a pivot arm 6 and a squeezing drive 7 to an electric vibration drive 8. Each pivot arm 6 has an upper pivot axis 9 on which the squeezing drive 7 is mounted. Each pivot arm 6 is mounted on the tool carrier 4 for rotation about a lower pivot axis 10. A tamping unit 1 of this type is intended for installation into a track tamping machine mobile on the track 3, or a tamping satellite.

Figure 2:
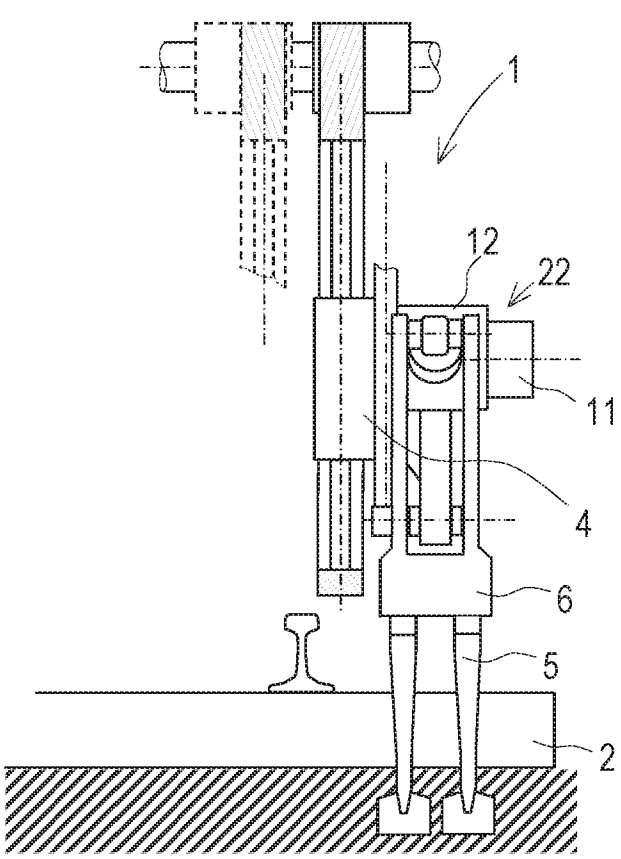

Shown in FIG. 2 is a side view of the tamping unit 1, wherein the latter is in a lowered position. The vibration drive 8 of the tamping unit 1 comprises an electric motor 22 with a motor housing 11 which is fastened to a front side of an eccenter housing 12.

Figure 3:
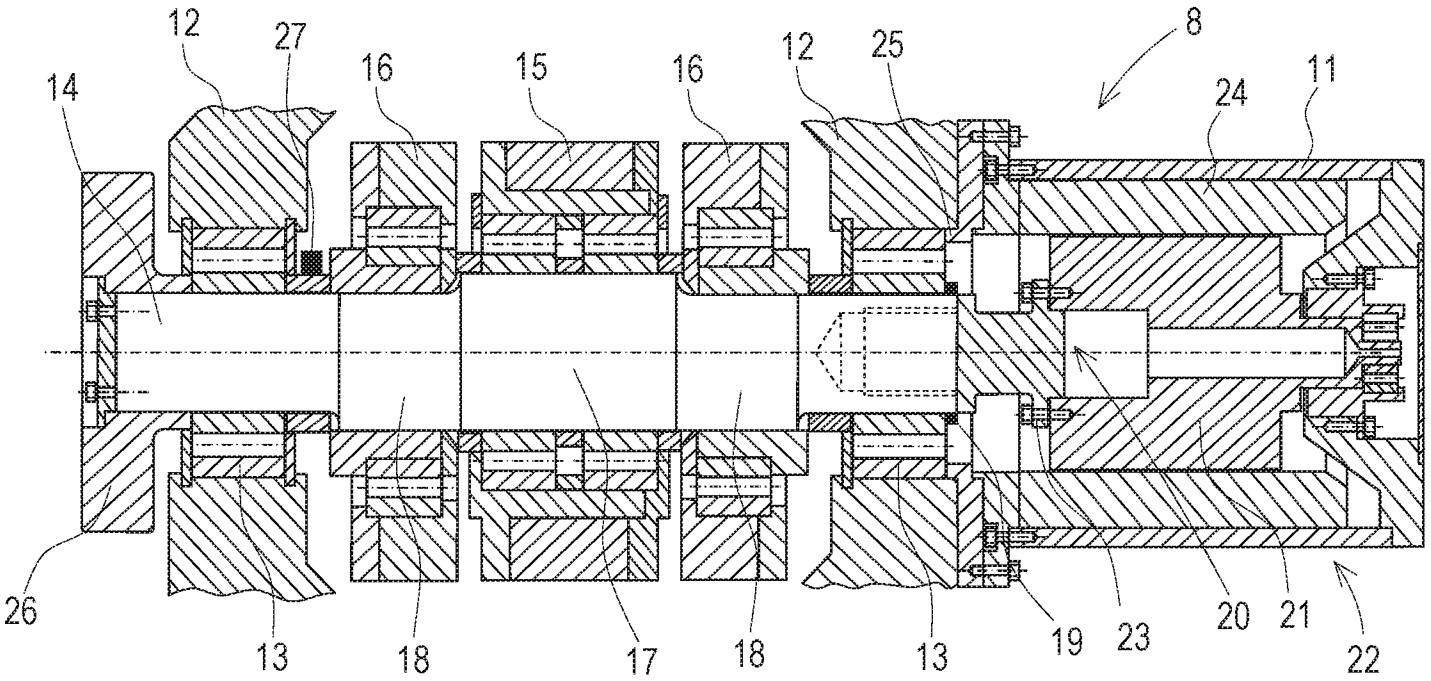

FIG. 3 shows a detail view of the electric vibration drive 8 including the eccentric housing 12 and motor housing 11. An eccentric shaft 14 is rotatably mounted in the eccenter housing 12 by means of roller bearings 13. Mounted on the eccentric shaft 14 are the squeezing drives 7 designed as hydraulic cylinders 15, 16. Here also, roller bearings are advantageously used. In this, the mounting of the eccentric shaft 14 is sufficiently precise and stable to also function as single mounting of a rotor 21 of the electric motor 22.

In the embodiment shown, the eccentric shaft 14 has two eccentrics 17, 18. The first hydraulic cylinder 15 is mounted on the first eccentric 17. For symmetrical force transmission, the second eccentric 18 is divided into two sections at both sides of the first eccentric 17. The second hydraulic cylinder 16 is mounted on said second eccentric 18 by means of a fork-shaped connection.

In an alternative embodiment not shown, only one eccentric is provided on which a transmission element in the shape of a connecting rod is arranged. With this, for example, a vibratory motion directed upwards downwards which is transmitted to inclined arranged squeezing drives 7. In this, the position of the squeezing drives 7 with respect to the transmission element determines the vibration amplitude transmitted to the tamping tools 5.

The eccenter housing 12 is sealed off towards the motor housing 11 by means of a sealing ring 19. At an end 20 of the eccentric shaft 14 facing the motor housing 11, the rotor 21 of the electric motor 22 is arranged and connected form-lockingly to the eccentric shaft 14. The form-locking connection 23 shown in FIG. 3 is designed as a screw connection, wherein the rotor 21 is positioned at the eccentric shaft 14 by means of a centering.

The electric motor 22 is designed as a torque motor. In this, the dimensioning can be adapted to the shape of the tamping unit. With the nominal torque remaining constant, for example, the design depth of the motor 22 can be reduced with increased diameter. Thus, the effect of the rotor 21 as oscillating weight can be optimized also. The compact design is additionally achieved by omission of a separate mounting for the rotor 21.

A stator 24 of the electric motor 22 is arranged within the motor housing 11. It is important that the stator 24 is precisely aligned with respect to the rotor 21 in order to ensure an even air gap in both the perimeter direction as well as the longitudinal direction. This is achieved in a simple manner by way of a centering 25 of the motor housing 11 with respect to the eccenter housing 12.

Optionally, the eccentric shaft 14 can have an additional flywheel 26 at a side facing away from the motor housing 11 in order to further increase the oscillating weight, if needed. In addition, a rotary encoder 27 for position recognition may be arranged on the eccentric shaft 14.

Figure 4:
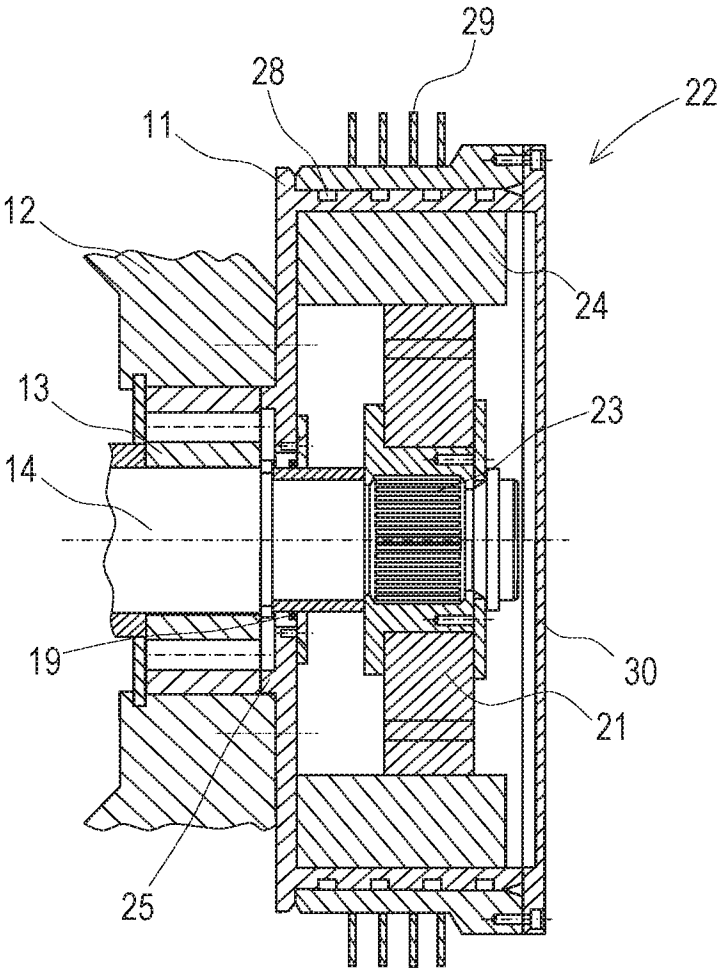

FIG. 4 shows a further design variant of the motor housing 11, flange-connected to the eccenter housing 12, of an electric motor 22 designed as a torque motor. Here, the form-locking connection 23 is designed as exterior teeth of the eccentric shaft 14 and interior teeth of a sleeve connected to the rotor 21.

The torque motor has a small design depth which has a positive effect on an installation width of the entire tamping unit 1. This design allows a particularly precise centering of the rotor 21 with respect to the eccentric shaft 14, and of the motor housing 11 including stator 24 with respect to the eccenter housing 12.

The motor housing 11 is sealed in itself and towards the eccenter housing in order to preclude a contamination of the rotor 21 and the stator 24. A cover 30 of the motor housing 11, fastened by means of screws enables a quick inspection of the electric motor 22.

Cooling channels 28 for liquid cooling are arranged around the motor housing 11. Additional cooling is effected by cooling fins 29 arranged around the cooling channels 28. By means of a pump, not shown, coolant is conducted continuously through the cooling channels 28 to dissipate the heat generated during operation. With this, an overheating of the electric motor 22 is reliably prevented even in the event of high outside temperatures and strong solar radiation.

The invention claimed is:

1. A tamping unit for tamping sleepers of a track, the tamping unit comprising:
- a lowerable tool carrier;
- oppositely-positioned tamping tools;
- a squeezing drive for producing a squeezing motion;
- an electric vibration drive for producing a vibratory motion, said electric vibration drive having an eccentric shaft and an electric motor with a rotor, a stator and a motor housing;
- pivot arms each connecting a respective one of said tamping tools to said squeezing drive and to said electric vibration drive;
- an eccenter housing;
- said eccentric shaft and said rotor being mounted only in said eccenter housing;
- said eccentric shaft having an end facing said motor housing, and a form-locking connection disposed between said end and said rotor; and
- said stator and said motor housing being flange-mounted to said eccenter housing.

2. The tamping unit according to claim 1, wherein said electric motor is an internal-rotor torque motor.

3. The tamping unit according to claim 1, which further comprises a bushing connected to said rotor, said bushing having internal teeth, said eccentric shaft having external teeth, and said form-locking connection being formed by said external and internal teeth.

4. The tamping unit according to claim 1, wherein said form-locking connection is a screw connection.

5. A tamping unit for tamping sleepers of a track, the tamping unit comprising:
- a lowerable tool carrier;

oppositely-positioned tamping tools;

a squeezing drive for producing a squeezing motion;

an electric vibration drive for producing a vibratory motion, said electric vibration drive having an eccentric shaft and a water-cooled electric motor with a rotor, a stator and a motor housing;

pivot arms each connecting a respective one of said tamping tools to said squeezing drive and to said electric vibration drive;

an eccenter housing;

said eccentric shaft and said rotor being mounted only in said eccenter housing; and said stator and said motor housing being flange-mounted to said eccenter housing.

6. A tamping unit for tamping sleepers of a track, the tamping unit comprising:

a lowerable tool carrier;

oppositely-positioned tamping tools;

a squeezing drive for producing a squeezing motion;

an electric vibration drive for producing a vibratory motion, said electric vibration drive having an eccentric shaft and an electric motor with a rotor, a stator and a motor housing;

pivot arms each connecting a respective one of said tamping tools to said squeezing drive and to said electric vibration drive;

an eccenter housing;

said eccentric shaft and said rotor being mounted only in said eccenter housing;

said stator and said motor housing being flange-mounted to said eccenter housing; and a sealing ring sealing said motor housing relative to said eccenter housing at a feed-through of said eccentric shaft.

7. The tamping unit according to claim 1, which further comprises a centering positioning said motor housing relative to said eccenter housing.

8. The tamping unit according to claim 1, wherein said eccentric shaft has a plurality of different eccentric sections, and said different eccentric sections are associated with respective oppositely-positioned tamping tools.

9. The tamping unit according to claim 1, wherein said eccentric shaft has an eccentric section, and a transmission element for transmitting the vibratory motion is mounted on said eccentric section.

* * * * *